US009325157B2

(12) United States Patent
Kawada

(10) Patent No.: US 9,325,157 B2
(45) Date of Patent: Apr. 26, 2016

(54) DISCHARGE ELECTRODE AND NEUTRALIZATION DEVICE

(71) Applicant: Panasonic Industrial Devices SUNX Co., Ltd., Kasugai-shi, Aichi-ken (JP)

(72) Inventor: Keiji Kawada, Kasugai (JP)

(73) Assignee: Panasonic Industrial Devices SUNX Co., Ltd., Aichi-ken (JP)

( * ) Notice: Subject to any disclaimer, the term of this patent is extended or adjusted under 35 U.S.C. 154(b) by 0 days.

(21) Appl. No.: 14/650,861

(22) PCT Filed: Nov. 19, 2013

(86) PCT No.: PCT/JP2013/081198
§ 371 (c)(1),
(2) Date: Jun. 9, 2015

(87) PCT Pub. No.: WO2014/125693
PCT Pub. Date: Aug. 21, 2014

(65) Prior Publication Data

US 2015/0333489 A1 Nov. 19, 2015

(30) Foreign Application Priority Data

Feb. 14, 2013 (JP) ..... 2013-026705

(51) Int. Cl.
*H01T 19/04* (2006.01)
*H01T 23/00* (2006.01)
*H05F 3/04* (2006.01)

(52) U.S. Cl.
CPC ..... *H01T 19/04* (2013.01); *H01T 23/00* (2013.01); *H05F 3/04* (2013.01)

(58) Field of Classification Search
USPC ..... 250/324, 325, 326
See application file for complete search history.

(56) References Cited

U.S. PATENT DOCUMENTS 5,017,876 A * 5/1991 Wright ..... G01R 19/0061 324/459
5,319,481 A * 6/1994 Fergason ..... G11B 7/00555 349/1
2008/0190294 A1* 8/2008 Sato ..... H05F 3/04 96/63
2011/0115362 A1* 5/2011 Sekoguchi ..... B03C 3/383 313/230

FOREIGN PATENT DOCUMENTS

JP 5-17999 U 3/1993
JP 2004-228069 A 8/2004
JP 2011-18477 A 1/2011

OTHER PUBLICATIONS

International Preliminary Report on Patentability dated Aug. 18, 2015, issued by the International Searching Authority in corresponding International Application No. PCT/JP2013/081198.

* cited by examiner

*Primary Examiner* — Kiet T Nguyen

(57) ABSTRACT

A discharge electrode that generates ions when supplied with a voltage includes a first part, a second part, and a third part. The first part includes a basal end and a distal end. The second part includes a basal end, which is continuous with the distal end of the first part, and a distal end. The third part includes a basal end, which is continuous with the distal end of the second part, and a convex surface defining a distal surface of the discharge electrode. The first to third parts are formed integrally. The basal end of the first part is wider than the distal end thereof. The second part is rod-shaped and has a width that is constant from the distal end to the basal end of the second part. The width of the second part is the same as that of the basal end of the third part.

5 Claims, 5 Drawing Sheets

DISCHARGE ELECTRODE AND NEUTRALIZATION DEVICE

CROSS REFERENCE TO RELATED APPLICATIONS

This application is a National Stage of International Application No. PCT/JP2013/081198 filed Nov. 19, 2013, claiming priority based on Japanese Patent Application No. 2013-026705, filed Feb. 14, 2013, the contents of all of which are incorporated herein by reference in their entirety.

TECHNICAL FIELD

The present invention relates to a discharge electrode that generates ions when supplied with a voltage, and a neutralization device that includes the discharge electrode.

BACKGROUND ART

In the prior art, a widely known neutralization device performs electrical neutralization by applying a voltage to a discharge electrode to produce a corona discharge, which generates ions, and ejecting the ions toward a neutralization subject. A discharge electrode used in such a neutralization device has the form of a truncated cone in which a distal portion of the discharge electrode gradually widens from a distal end toward a basal end. This increases the strength of the entire discharge electrode (e.g., refer to patent document 1).

Patent Document 1: Japanese Unexamined Utility Model Publication No. 5-17999

SUMMARY OF THE INVENTION

The distal portion of the above discharge electrode has a varying width from the distal end to the basal end. Thus, long-term use of the discharge electrode may cause wear that rounds the distal portion and changes the curvature of the distal portion. This varies the amount of ions generated by the discharge electrode even when the same amount of voltage is applied to the discharge electrode.

To solve the above problem, it is an object of the present invention to provide a discharge electrode and a neutralization device that limit decreases in the strength and reduce variations in the discharge amount under the same voltage.

A first aspect of the present invention is a discharge electrode that generates ions when supplied with a voltage. The discharge electrode includes a first part, a second part, and a third part. The first part has a predetermined length and includes a basal end and a distal end. The second part includes a basal end, which is continuous with the distal end of the first part, and a distal end. The third part includes a basal end, which is continuous with the distal end of the second part, and a convex surface, which defines a distal surface of the discharge electrode. The first part, the second part, and the third part are formed integrally. The basal end of the first part is wider than the distal end of the first part. The second part is rod-shaped and has a width that is constant from the distal end to the basal end of the second part. The width of the second part is the same as that of the basal end of the third part.

In the above structure, the basal end of the first part is wider than the distal end of the first part. This increases the strength of the entire discharge electrode compared to when the first part has a constant width from the distal end to the basal end. Additionally, when the third part of the discharge electrode is worn away due to use from the distal end to the basal end, the second part, which is continuous with the basal end of the third part, becomes the distal portion of the discharge electrode. In this case, the second part has a constant width entirely from the distal end to the basal end. Additionally, the width of the second part is the same as the width of the basal end of the third part, which is continuous with the second part. Thus, even when the third part is worn away and the second part becomes the distal portion of the discharge electrode, the width of the distal portion of the discharge electrode is generally unvaried before and after the third part of the discharge electrode is worn. Additionally, the second part is rod-shaped and has a constant width from the distal end to the basal end. Thus, the width of the distal portion of the discharge electrode remains generally the same as the second part gradually wears from the distal end to the basal end. As a result, even when long-term use gradually wears the distal portion of the discharge electrode from the distal end toward the basal end so that the distal portion forms a convex surface, such as, a hemispheric surface, the distal surface of the distal portion of the discharge electrode may have a curvature that remains generally the same during this period. This limits variations in the amount of discharge from the discharge electrode under the same voltage. Thus, variations in the discharge amount may be limited under the same voltage while limiting a decrease in the strength.

In the discharge electrode, it is preferred that the second part have a dimension in a longitudinal direction of the discharge electrode that is greater than that of the third part.

The above structure provides sufficient time before the second part wears away from the distal end to the basal end due to use. Thus, variations in the discharge amount may be limited under the same voltage for a longer period.

In the discharge electrode, it is preferred that the convex surface of the third part be a convex and spherical surface.

In the above structure, before the third part of the discharge electrode wears due to use, the convex surface of the third part, which defines the distal surface of the distal portion of the discharge electrode, has a convex shape. This limits variations before and after use in the shape of the distal surface of the distal portion of the discharge electrode. Thus, variations in the amount of discharge from the discharge electrode may be further limited under the same voltage.

In the discharge electrode, it is preferred that the second part and the third part be formed from the same material.

In the above structure, the material of the distal portion of the discharge electrode is the same before and after the third part of the discharge electrode wears due to use and the second part becomes the distal portion of the discharge electrode. This further limits variations in the amount of discharge from the discharge electrode under the same voltage.

A second aspect of the present invention is a neutralization device. The neutralization device includes a discharge electrode according to the first aspect that is used to generate ions supplied to a neutralization subject and an opposing electrode arranged to surround the discharge electrode.

The above structure has the same advantages as the first aspect.

The present invention limits a decrease in the strength and also limits variations in the discharge amount under the same voltage.

DESCRIPTION OF THE EMBODIMENTS

One embodiment of a neutralization device will now be described with reference to the drawings.

Figure 1:
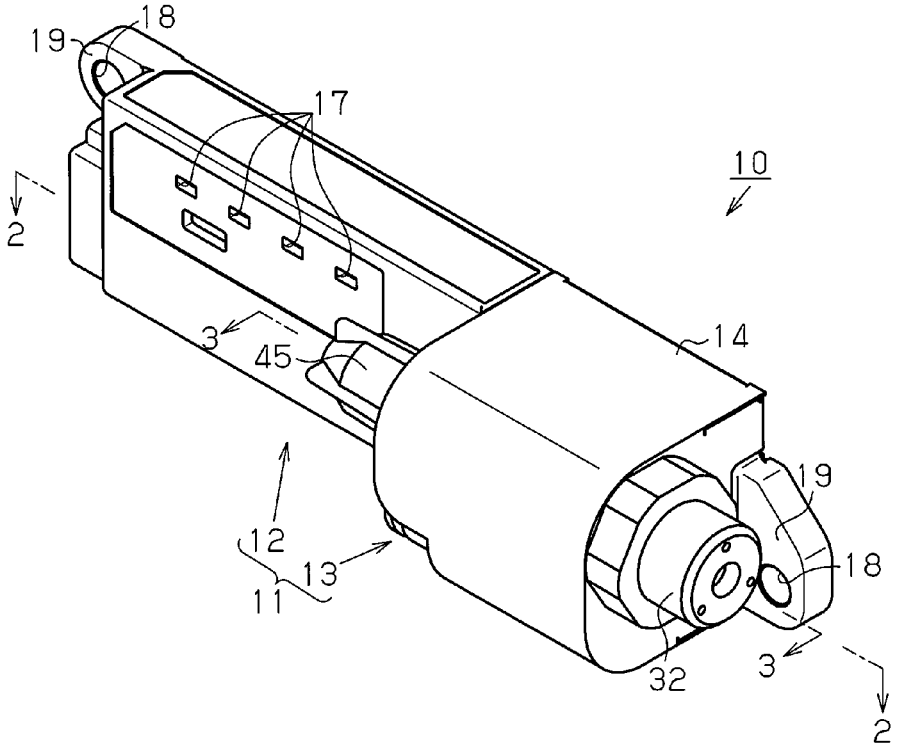
FIG. 1 is a perspective view of one embodiment of a neutralization device.

As shown in FIG. 1, a body case 11 forms the exterior of a neutralization device 10. The body case 11 includes a board retainer 12 and a head 13, which is formed integrally with the board retainer 12. The board retainer 12 is box-shaped and elongated in one direction. The head 13 is adjacent to one longitudinal end of the outer surface of the board retainer 12. The head 13 is box-shaped and elongated parallel to the longitudinal direction of the board retainer 12. The board retainer 12 includes a surface having an opening. The opening of the board retainer 12 and the entire head 13 are covered from an outer side by a cover 14, which is attached to the body case 11.

Figure 2:
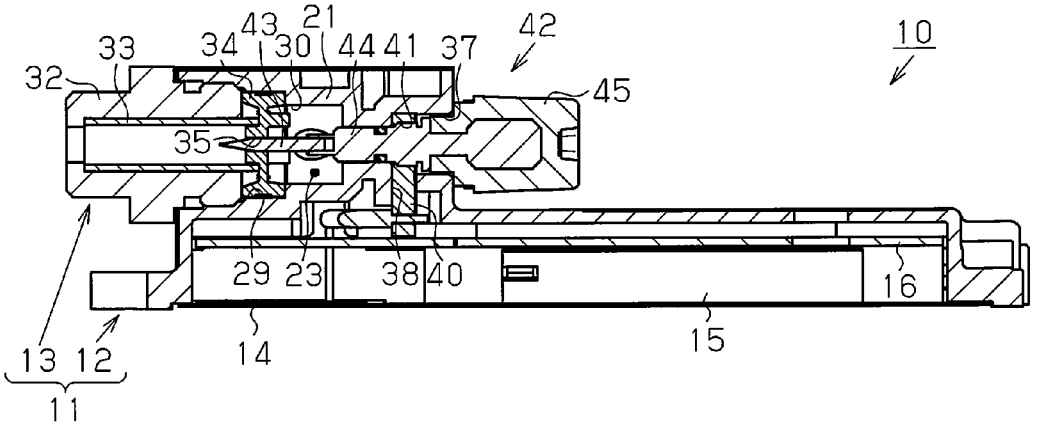
FIG. 2 is a cross-sectional view taken along line 2-2 in FIG. 1 in the direction of the arrow.

As shown in FIG. 2, the board retainer 12 accommodates a printed circuit board 16, which includes a drive circuit 15. The printed circuit board 16 includes a plurality of LEDs (not shown) indicating operational conditions of the neutralization device 10. The LEDs are opposed to the exterior of the body case 11 through windows 17 (refer to FIG. 1) formed in the board retainer 12.

As shown in FIG. 1, coupling portions 19 project from the two longitudinal sides of the board retainer 12. Each coupling portion 19 includes a coupling hole 18. Fastening screws (not shown) are inserted into the coupling holes 18 of the coupling portions 19 and fastened to predetermined coupling locations to fix the neutralization device 10.

Figure 3:
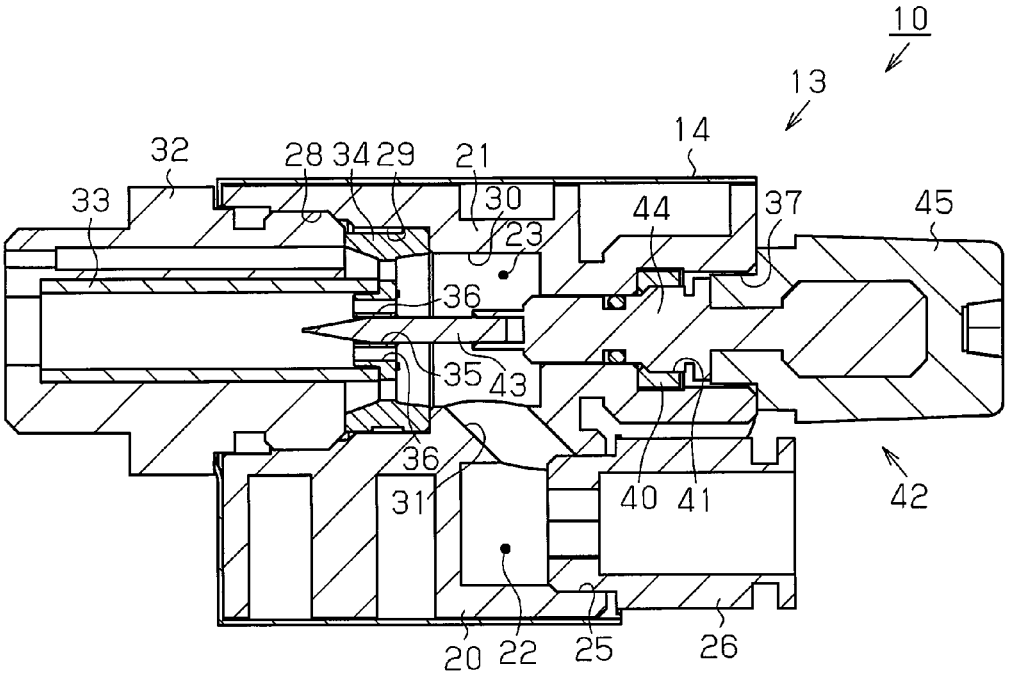
FIG. 3 is a cross-sectional view taken along line 3-3 in FIG. 1 in the direction of the arrow.
Figure 4A:
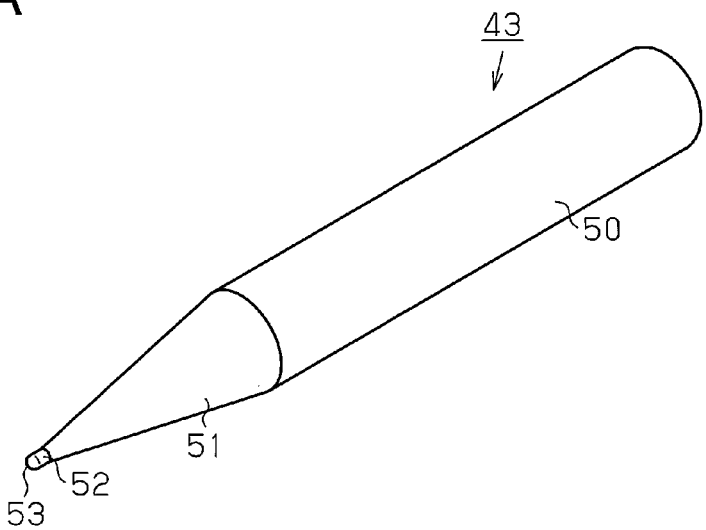
FIG. 4A is a perspective view of a discharge electrode of the embodiment.
Figure 4B:
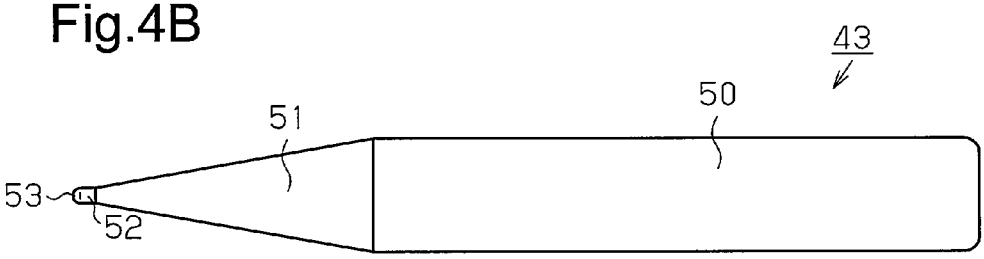
FIG. 4B is a front view of the discharge electrode of the embodiment.
Figure 4C:
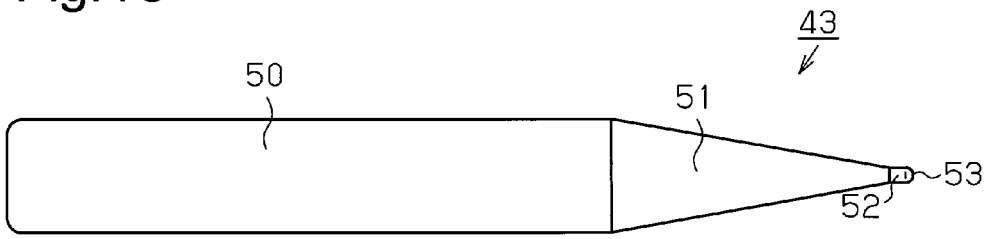
FIG. 4C is a rear view of the discharge electrode of the embodiment.
Figure 4D:
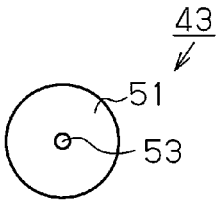
FIG. 4D is a left side view of the discharge electrode of the embodiment.
Figure 4E:
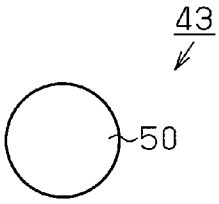
FIG. 4E is a right side view of the discharge electrode of the embodiment.

As shown in FIG. 3, the head 13 includes an air supply portion 20 and an ion generation portion 21, which are arranged beside each other. The air supply portion 20 is tubular and has a closed end. The air supply portion 20 includes a cavity 22 that opens at the side of a first longitudinal end (right end in FIG. 3) of the head 13. The ion generation portion 21 is tubular and includes a cavity 23 that opens at the sides of the first longitudinal end and a second longitudinal end (left end in FIG. 3) of the head 13.

In the air supply portion 20, the open end of the cavity 22 serves as an attachment hole 25. An air tube holder 26 is fitted into the attachment hole 25. The air tube holder 26 is connected to one end of an air tube (not shown). The other end of the air tube is connected to an air supply source (not shown).

In the ion generation portion 21, the open end of the cavity 23 that opens at the second longitudinal end of the head 13 serves as a nozzle attachment hole 28. The inner wall of the nozzle attachment hole 28 includes a threaded groove. Also, the cavity 23 of the ion generation portion 21 includes a receptacle 29 and an air inlet 30. The receptacle 29 has an inner diameter that is substantially the same as the nozzle attachment hole 28. The air inlet 30 has a smaller inner diameter than the receptacle 29. The nozzle attachment hole 28, the receptacle 29, and the air inlet 30 are arranged in this order and in communication with one another. The body case 11 also includes a communication passage 31 that connects the air inlet 30 and the cavity 22 of the air supply portion 20.

A tubular nozzle 32 is attached to the nozzle attachment hole 28. The nozzle 32 is a conductor formed from metal (e.g., stainless steel) and connected to ground (ground level). The nozzle 32 functions as an opposing electrode. The outer circumferential surface of the nozzle 32 includes a threaded groove. When the threaded groove of the nozzle 32 is engaged with the threaded groove formed in the inner wall of the nozzle attachment hole 28, the nozzle 32 is coupled to the head 13. An insulation tube 33, which is cylindrical and formed from an insulative material, is fitted into the nozzle 32.

Also, an air passage member 34 is fitted into the receptacle 29 from the inner side. The air passage member 34 is disk-shaped in conformance with the cross-sectional shape of the receptacle 29 as a whole. A through hole 35 extends through the center of the air passage member 34 in the thicknesswise direction. Also, a plurality of vents 36 extend through the air passage member 34 in the thicknesswise direction. The vents 36 are arranged around the through hole 35.

As shown in FIG. 2, a portion of the ion generation portion 21 located at the side of the first longitudinal end of the head 13 serves as a unit insertion hole 37. The inner wall of the unit insertion hole 37 includes an opening defining a through hole 38. The through hole 38 connects the board retainer 12 and the unit insertion hole 37. The through hole 38 receives a plate-shaped nut 40, which is coupled to the printed circuit board 16. The nut 40 is electrically connected to the drive circuit 15 mounted on the printed circuit board 16. The nut 40 includes a female-threaded hole 41. The hole center of the female-threaded hole 41 is aligned with the hole center of the unit insertion hole 37.

The unit insertion hole 37 receives a discharge electrode unit 42. The discharge electrode unit 42 includes a discharge electrode 43, a discharge electrode holder 44 holding a basal portion of the discharge electrode 43, and a grip 45. The grip 45 is formed integrally with the discharge electrode holder 44 and covers a basal portion of the discharge electrode holder 44. The outer circumferential surface of the discharge electrode holder 44 includes a male thread. When the discharge electrode unit 42, which includes the discharge electrode 43 at the distal end of the discharge electrode unit 42, is inserted through the unit insertion hole 37 into the cavity 23 of the ion generation portion 21, the grip 45 is rotated. This engages the male thread of the discharge electrode holder 44 with the female-threaded hole 41 of the nut 40.

The structure of the discharge electrode 43 will now be described in detail.

As shown in FIGS. 4A to 4E, the discharge electrode 43 includes a rod-shaped base 50, a first part 51 that has the form of a truncated cone and is continuous with a distal end of the base 50, a rod-shaped second part 52 that is continuous with a distal end of the first part 51, and a hemispherical third part 53 that is continuous with a distal end of the second part 52.

The first part 51 has a predetermined length in the longitudinal direction of the discharge electrode 43. The first part 51 gradually widens from the distal end to the basal end. More specifically, the basal end of the first part 51, which is continuous with the base 50, is wider than the distal end of the first part 51, which is continuous with the second part 52. In the present example, the basal end of the first part 51, which is continuous with the base 50, and the base 50 have the same diameter. The distal end of the first part 51, which is continuous with the second part 52, and the second part 52 have the same diameter.

Figure 5:
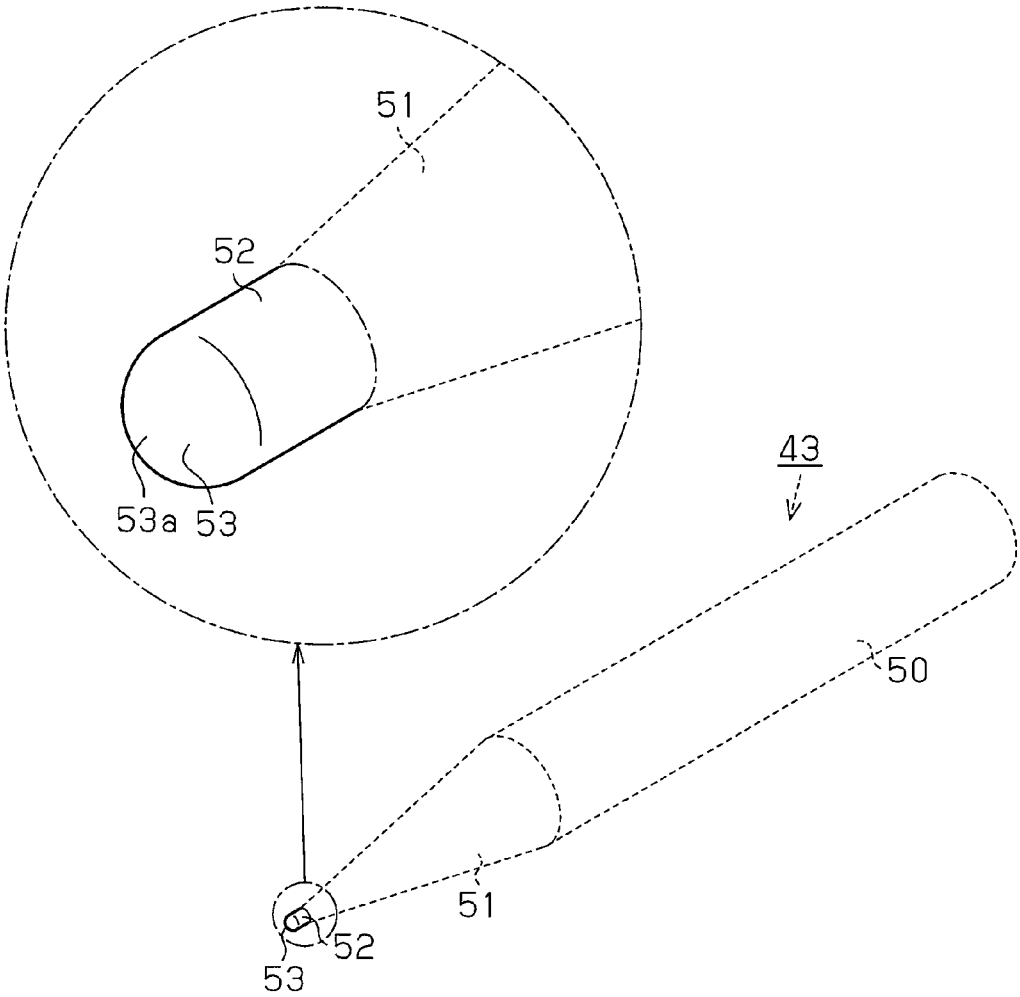
FIG. 5 is a perspective view of a portion of the discharge electrode of the embodiment.

As shown in FIG. 5, the second part 52 has a constant width from the distal end to the basal end. The diameter of the second part 52 is the same as the diameter of the third part 53. Thus, the circumferential surface of the basal end of the third part 53 is flush with the circumferential surface of the distal end of the second part 52 and forms no steps. In other words, the second part 52 and the basal end (side that contacts the second part 52) of the third part 53 have the same width. The longitudinal dimension of the second part 52 from the distal end to the basal end is greater than the radius of the third part 53. Thus, in the longitudinal direction of the discharge electrode 43, the dimension of the second part 52 is greater than the dimension of the third part 53. The third part 53 includes an outer surface 53*a* defining the distal surface of the discharge electrode 43. The outer surface 53*a* is machined to have a spherical surface. Thus, the outer surface 53*a* of the third part 53 is a hemispherical and convex surface. The base 50, the first part 51, the second part 52, and the third part 53 are formed from the same metal material (e.g., tungsten). One example of the longitudinal dimensions of the first part 51, the second part 52, and the third part 53 is as follows. The first part 51 is approximately 12 mm. The second part 52 is approximately 0.3 mm. The third part 53 is approximately 0.2 mm. The longitudinal dimensions of the second part 52 and the third part 53 are considerably shorter than the first part 51.

The operation of the neutralization device 10, which is configured in the above manner, will be now be described, focusing, particularly, on the operation when the discharge electrode 43 is supplied with a voltage and discharged.

When the drive circuit 15 applies a high voltage to the nut 40, a corona discharge is produced from the distal end of the discharge electrode 43, which is electrically connected to the nut 40, toward the nozzle 32, which is the opposing electrode. As a result, ions are generated. The generated ions are ejected from the nozzle 32 to the exterior along the flow of air from the air supply portion 20 through the communication passage 31, the air inlet 30, the air passage member 34, the vents 36, and the insulation tube 33.

Figure 6A:
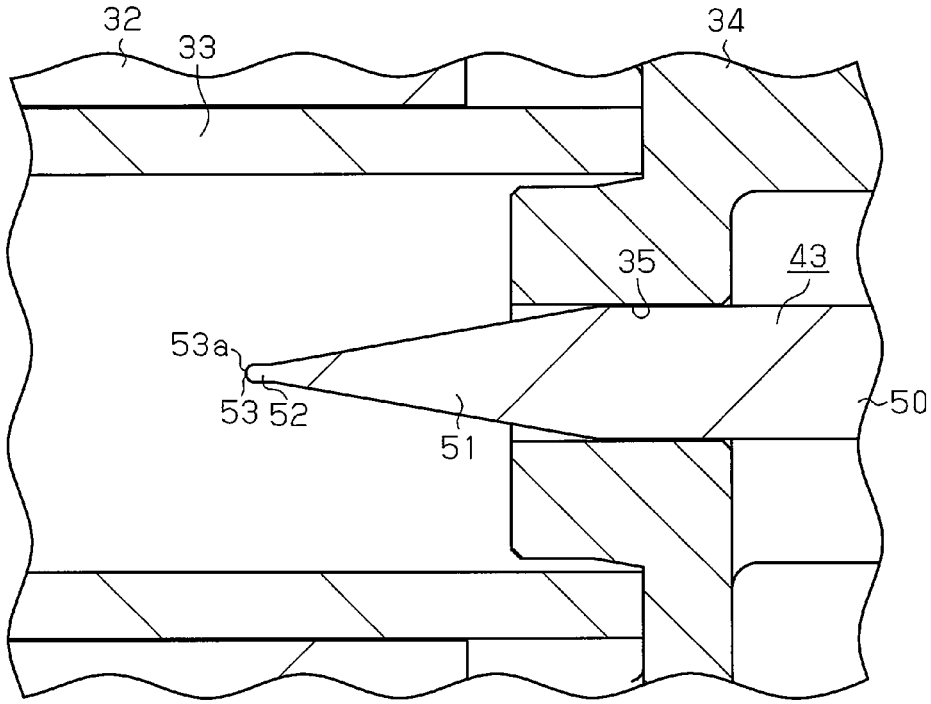
FIG. 6A is a cross-sectional view showing the peripheral structure of the discharge electrode of the embodiment before a third part of the discharge electrode is worn.

As shown in FIG. 6A, when a corona discharge is produced from the distal end of an unused discharge electrode 43 toward an inner surface of the nozzle 32, the third part 53 serves as a distal portion of the discharge electrode 43. The outer surface 53*a* of the third part 53 serves as a distal surface of the discharge electrode 43. In this case, the distal surface of the discharge electrode 43 is a hemispherical and convex surface.

Figure 6B:
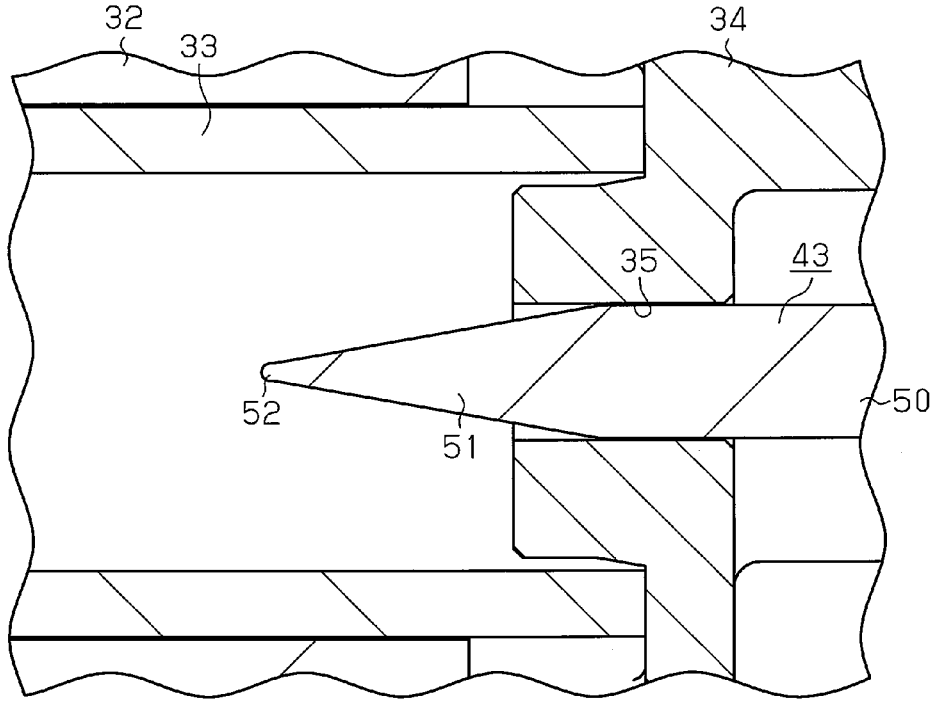
FIG. 6B is a cross-sectional view showing the peripheral structure of the discharge electrode of the embodiment after the third part of the discharge electrode is worn.

As shown in FIG. 6B, when the discharge electrode 43 is discharged over a long period, the distal portion of the discharge electrode 43 gradually wears from the distal end to the basal end and forms a convex surface, such as, a hemispheric surface. Consequently, the third part 53 is worn away from the distal end to the basal end. Thus, the distal end of the second part 52, which is continuous with the basal end of the third part 53, becomes the distal portion of the discharge electrode 43.

In this case, the width of the entire second part 52 is constant from the distal end to the basal end. Also, the width of the second part 52 is the same as the width of the basal end of the third part 53, which is continuous with the second part 52. Thus, even when the third part 53 is worn away and the second part 52 becomes the distal portion of the discharge electrode 43, the width of the distal portion of the discharge electrode 43 is generally the same before and after the third part 53 of the discharge electrode 43 is worn.

Consequently, the curvature of the convex surface formed on the second part 52 of the discharge electrode 43 resulting from the wear of the distal portion of the discharge electrode 43 is substantially the same as the curvature of the outer surface 53*a* of the third part 53 of the unused discharge electrode 43. Thus, even when long-term use gradually wears the distal portion of the discharge electrode 43 from the distal end toward the basal end, the curvature of the distal surface of the distal portion of the discharge electrode 43 generally remains the same during this period.

More specifically, to maintain substantially the same shape for the distal surface of the distal end of the discharge electrode 43, substantially the same distance is maintained between the distal surface of the distal portion of the discharge electrode 43 and the inner surface of the insulation tube 33. Thus, under the same voltage, or when the same voltage is applied from the drive circuit 15, the amount of discharge from the distal end of the discharge electrode 43 toward the inner surface of the nozzle 32 remains generally the same. In this situation, ions are generated. The ions have substantially the same density when ejected through the nozzle 32 to the exterior.

The embodiment has the advantages described below.

(1) In the first part 51, the basal end is wider than the distal end. This increases the strength of the entire discharge electrode 43 compared to when the width of the first part 51 is constant from the distal end to the basal end. Additionally, the third part 53 of the discharge electrode 43 may be worn away due to use from the distal end to the basal end. Consequently, the second part 52, which is continuous with the basal end of the third part 53, becomes the distal portion of the discharge electrode 43. In this case, the width of the second part 52 is constant entirely from the distal end to the basal end. Additionally, the width of the second part 52 is the same as the width of the basal end of the third part 53, which is continuous with the second part 52. Thus, even when the third part 53 is worn away and the second part 52 becomes the distal portion of the discharge electrode 43, the width of the distal portion of the discharge electrode 43 is generally the same before and after the third part 53 of the discharge electrode 43 is worn. Additionally, the second part 52 is rod-shaped and has a constant width from the distal end to the basal end. Thus, the width of the distal portion of the discharge electrode 43 remains generally the same as the second part 52 wears gradually from the distal end to the basal end. As a result, even when long-term use gradually wears the distal portion of the discharge electrode 43 from the distal end toward the basal end so that the distal portion forms a convex surface, such as, a hemispheric surface, the curvature of the distal surface of the distal portion of the discharge electrode 43 is generally the same during this period. This limits variations in the amount of discharge from the discharge electrode 43 under the same voltage. Thus, variations in the discharge amount may be limited under the same voltage while limiting a decrease in the strength.

(2) In the longitudinal direction of the discharge electrode 43, the dimension of the second part 52 is greater than the dimension of the third part 53. This provides sufficient time before the second part 52 is worn away from the distal end to the basal end due to use. Thus, variations in the discharge amount may be limited under the same voltage for a longer period.

(3) The outer surface 53*a* of the third part 53 is machined to form a convex and spherical surface. Thus, before the third part 53 of the discharge electrode 43 wears due to use, the outer surface 53*a* of the third part 53, which defines the distal surface of the distal portion of the discharge electrode 43, has a convex shape. This limits variations in the shape of the distal surface of the distal portion of the discharge electrode 43 before and after use. Thus, variations in the amount of discharge from the discharge electrode 43 may be further limited under the same voltage.

(4) The second part 52 and the third part 53 of the discharge electrode 43 are formed from the same material. Thus, the material of the distal portion of the discharge electrode 43 is unchanged before and after the third part 53 of the discharge electrode 43 wears due to use resulting in the second part 52 becoming the distal portion of the discharge electrode 43. This further limits variations in the amount of discharge from the discharge electrode 43 under the same voltage.

(5) The nozzle 32 surrounds the discharge electrode 43, which functions as the opposing electrode. Thus, the discharge electrode 43 wears so that the entire periphery of the discharge electrode 43 is evenly worn. This limits variations in the shape of the distal surface. Thus, variations in the discharge amount are limited.

The embodiment may be modified as follows.

In the embodiment, the parts 51, 52, 53 of the discharge electrode 43 do not necessarily have to be formed from the same material. For example, the parts 51, 52, 53 may be formed from different materials. However, it is preferred that at least the second part 52 and the third part 53 be formed from the same material.

In the embodiment, the outer surface 53*a* of the third part 53 does not need to have a perfect convex and spherical shape and thus may have a generally convex and spherical shape including a slightly bulging portion. Further, the outer surface 53*a* of the third part 53 does not need to have a convex and spherical shape. For example, the outer surface 53*a* of the third part 53 may have a different convex shape, such as, a convex and elliptical shape, in which the curvature differs in vertical and horizontal directions, or a convex arc-like shape.

In the embodiment, the longitudinal dimension of the second part 52 from the distal end to the basal end may be less than or equal to the radius of the third part 53. That is, in the longitudinal direction of the discharge electrode 43, the dimension of the second part 52 may be less than or equal to the dimension of the third part 53.

In the embodiment, the first part 51 does not need to have the form of a truncated cone and may have a different shape, such as the form of a truncated pyramid or be hemispherical. Further, the first part 51 does not necessarily have to gradually widen from the distal end to the basal end. More specifically, as long as the basal end of the first part 51 is wider than the distal end of the first part 51, for example, a portion that is wider than the basal end of the first part 51 may be located between the distal end and the basal end of the first part 51.

In the embodiment, the second part 52 does not need to have the form of a round rod and may have the form of a polygonal rod. In this case, it is preferred that the second part 52 have the form of a polygonal rod having five or more corners, such as, a hexagonal rod.

The invention claimed is:

1. A discharge electrode that generates ions when supplied with a voltage, the discharge electrode comprising:

a first part that has a predetermined length and includes a basal end and a distal end;

a second part that includes a basal end, which is continuous with the distal end of the first part, and a distal end; and a third part that includes a basal end, which is continuous with the distal end of the second part, and a convex surface, which defines a distal surface of the discharge electrode, wherein the first part, the second part, and the third part are formed integrally, the basal end of the first part is wider than the distal end of the first part, the second part is rod-shaped and has a width that is constant from the distal end to the basal end of the second part, the width of the second part is the same as that of the basal end of the third part, and the first part has a dimension in a longitudinal direction of the discharge electrode that is greater than that of each of the second part and the third part.

2. The discharge electrode according to claim 1, wherein the dimension of the second part in the longitudinal direction of the discharge electrode is greater than that of the third part.

3. The discharge electrode according to claim 1, wherein the convex surface of the third part is a convex and spherical surface.

4. The discharge electrode according to claim 1, wherein the second part and the third part are formed from the same material.

5. A neutralization device comprising:

a discharge electrode according to claim 1 that generates ions supplied to a neutralization subject; and an opposing electrode arranged to surround the discharge electrode.

* * * * *